US006553929B1

(12) United States Patent
Harp

(10) Patent No.: US 6,553,929 B1
(45) Date of Patent: Apr. 29, 2003

(54) HAZARD MARKER

(76) Inventor: Kevin Louis Harp, 927 Burlwood Ct., Los Banos, CA (US) 93635

( * ) Notice: Subject to any disclaimer, the term of this patent is extended or adjusted under 35 U.S.C. 154(b) by 0 days.

(21) Appl. No.: 09/496,481

(22) Filed: Feb. 2, 2000

(51) Int. Cl.[7] ..... G09F 17/00; G09F 7/12

(52) U.S. Cl. ..... 116/173; 116/DIG. 24; 40/597; 248/363; 248/683

(58) Field of Search ..... 116/173, 28 R, 116/209, DIG. 24, 63 P; 40/591, 592, 612, 597; 248/537, 362, 363, 205.5, 205.8, 206.2, 683

(56) References Cited

U.S. PATENT DOCUMENTS 938,221 A * 10/1909 Dallimore ..... 116/173
952,495 A * 3/1910 Austin ..... 248/205.8
1,362,704 A * 12/1920 Johnson ..... 116/173
1,388,060 A * 8/1921 Ricigliano ..... 116/173
2,533,459 A * 12/1950 Holliday ..... 116/173
3,081,054 A * 3/1963 Westervelt ..... 116/28 R
3,255,725 A * 6/1966 Von Kreidner et al. ..... 116/173
4,332,210 A * 6/1982 Lambert ..... 116/173
4,762,358 A * 8/1988 Levosky et al. ..... 160/323.1
5,042,419 A * 8/1991 Bianco ..... 116/209
5,318,262 A * 6/1994 Adams ..... 248/205.8
5,729,926 A * 3/1998 Cowgill et al. ..... 116/173
5,947,544 A * 9/1999 Hubeshi ..... 160/23.1
6,115,951 A * 9/2000 Jing et al. ..... 116/63 P

* cited by examiner

*Primary Examiner*—Diego Gutierrez
*Assistant Examiner*—Madeline Gonzalez
(74) *Attorney, Agent, or Firm*—Intellectual Property of Law Offices of S. Alex Liao; S. Alex Liao

(57) ABSTRACT

A compact and convenient hazard marker has a housing and a suction insert. The bottom end of the housing covers the suction insert where the releasing tab for the suction is hidden within the housing. Another embodiment of the invention has a spring-loaded mechanical device attached to a flag inside the housing. The flag is extendable and retractable outside the housing. The flag is retained by a locking means. There are grooves on the exterior wall of the housing for easy storage. The housing and the flag are painted in fluorescent color.

6 Claims, 3 Drawing Sheets

HAZARD MARKER

FIELD OF THE INVENTION

The present invention relates to a hazard marker and more particularly, to the hazard marker commonly used in public places, such as supermarkets, shopping malls, or restaurants.

BACKGROUND OF THE INVENTION

Hazard markers commonly used in public places today, such as supermarkets, shopping malls, or restaurants, are plastic cone-shaped units. The walls of these cone-shaped units are painted with bright fluorescent color and a warning, such as "Be careful, Wet floor".

Other types of hazard markers currently used also include folding plastic board units. The plastic board unit has two plastic boards, which are hinged together on one edge. The plastic board unit can stand on the floor on its two movable edges of the boards. The boards are normally painted with bright fluorescent color and warning, such as "Be careful, Wet floor".

Each year, the industries like supermarkets incur a great deal of unnecessary expenses for compensating injured customers or individuals in personal injury claims, due to untimely responses to hazardous conditions by the supermarket personnel and to place a hazard marker on site. Some individuals' claims of personal injuries may not be legitimate because they purposely injure themselves at the hazardous condition and claim lack of any warning marker.

Hazard markers used in public places should be easily accessible, transportable, and storable. Particularly, in supermarkets where spillages are common occurrences, it is critical that clerks of the supermarket can timely respond to any hazardous spillage and conditions, to place a hazard marker on the spot, before any customers or people with an intent to file a personal injury claim arrive at the spot of the hazard condition.

The hazard markers currently used in the industries have several drawbacks and disadvantages. First, these markers are too bulky and unaesthetic to store around the areas where hazard conditions mostly occur. Because of their bulkiness, the current hazard markers have to be kept in a storage room. Therefore, there is a distance between the storage place and the spot of hazard conditions. As a result, there will be a time lapse between discovering a hazard condition and placing a hazard marker on the spot. Secondly, it is more expensive to manufacture the hazard markers currently used, and subsequently, more expensive for replacement. Finally, because of its inherent use and the materials, the currently available hazard markers get filthy easily and difficult to clean.

SUMMARY OF THE INVENTION

It is therefore an object of this invention to provide a hazard marker that is easily attachable and removable from the floor.

It is yet another object of this invention to provide an easily assessable hazard marker.

It is a further object of this invention to provide a less costly hazard maker.

It is yet another object of this invention to provide a hazard marker with a retractable and extendable flag or sign.

Therefore, according to one form of the present invention, there is provided a hazard marker comprising a housing having an interior wall, an exterior wall in fluorescent color, a top opening, and a bottom opening, a means for affixing said bottom opening of said housing to the floor and for releasing said bottom end from the floor, two grooves on said exterior wall for readily storing said marker, each said groove being closed to said top opening and said bottom opening.

In the first embodiment of the invention, the diameter of said housing at said bottom opening is gradually enlarged, and said bottom opening has a bottom closure having a first outwardly concaved surface. Said first outwardly concaved surface having a first central opening and a second opening.

Said means for affixing said bottom opening to the floor consists of a cylindrical suction base insert having a top receiving end and a bottom suction base. Said bottom suction base has a second outwardly concaved surface and an exterior surface, and a releasing tap on said exterior surface. The top end of said suction base insert is securely affixed into said first central opening and said releasing tap is movably retained inside said second opening. Said second outwardly concaved surface of said suction base will be securely attached onto the floor when a user pushes said marker downwardly against the floor, whereby said suction base will be released from the floor when the user pushes the housing in a predetermined direction.

In the second embodiment of the present invention, the bottom end of said housing is not enlarged. There provided a different assembly of a suction base insert having a top receiving end and a bottom suction base having an exterior surface and an outwardly concaved surface, and a releasing tap on said exterior surface of said suction base. Said receiving end is securely affixed onto said bottom end of said housing, whereby said outwardly concaved surface of said suction base will be securely attached onto the floor when a vertical force is applied on to said marker downwardly, whereby said suction base will be released from attaching to the floor when an user pushes the releasing tap in a predetermined direction.

In the third embodiment of the present invention, there is provided a hazard marker according to the first embodiment, wherein said housing further comprising:

a spring-loaded mechanical means inside said housing, said spring-loaded mechanical means having an extendable and retractable flag in fluorescent color, said spring-loaded means having a top end and a bottom end, said top end having a cap:

a stopping pin across the interior wall of said housing between said top opening and bottom opening of said housing, said bottom end of said spring-loaded means resting on said pin;

an opening slot on said housing, said flag retractably passing through said slot;

a locking mechanical means.

Said locking mechanical means further comprises a first bar being securely attached to an edge of said flag, a rotatable knob being attached to said first bar, a second bar having a first end and a second end. The diameter of the first bar is greater than the width of said slot. Said first end of the second bar is rotatably attached to said knob. A notch is made at said slot and a clip is affixed on said exterior of said housing, whereby said flag is extended by pulling said first bar horizontally and outwardly through said slot and said second end of said second bar is securely positioned into said notch, whereby said flag is retracted into said slot by the spring-loaded device when said second bar is released from a locking position and said second bar is retained by said clip.

BRIEF DESCRIPTION OF THE DRAWINGS

The invention will now be described with references to preferred embodiments by way of example, as illustrated in the accompanying drawings, in which.

DETAILED DESCRIPTION OF THE PREFERRED EMBODIMENT

Figure 1:
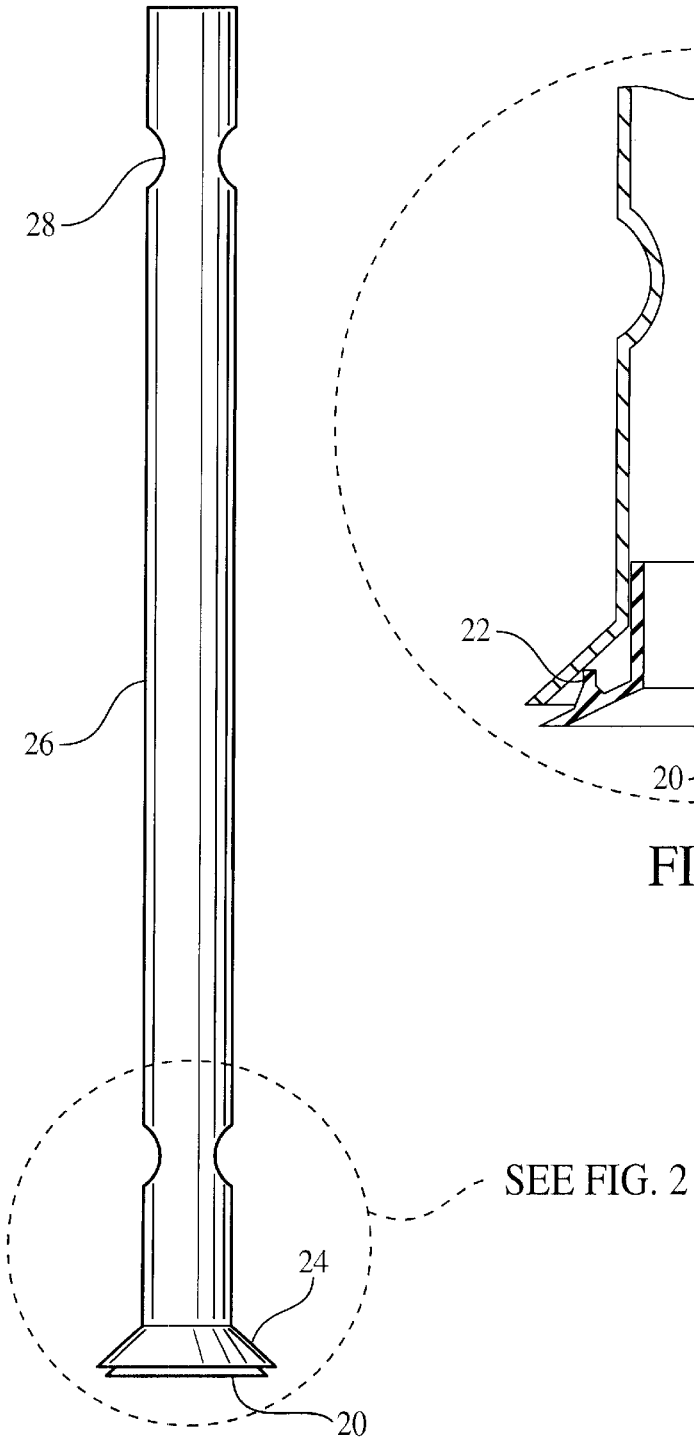
FIG. 1 is a side view of one embodiment of the invention.

Referring to FIG. 1, the first embodiment is illustrated. A hazard marker comprises a housing portion 26, a top opening, an enlarged bottom opening 24, a cylindrical suction base insert 20, and two grooves 28 on the housing exterior wall for clipping and storage. The housing 26 is cylindrical in shape or can be other suitable shapes. The housing exterior wall can be painted in bright fluorescent color and with warning words to alert walkers-by of hazard conditions.

Figure 2:
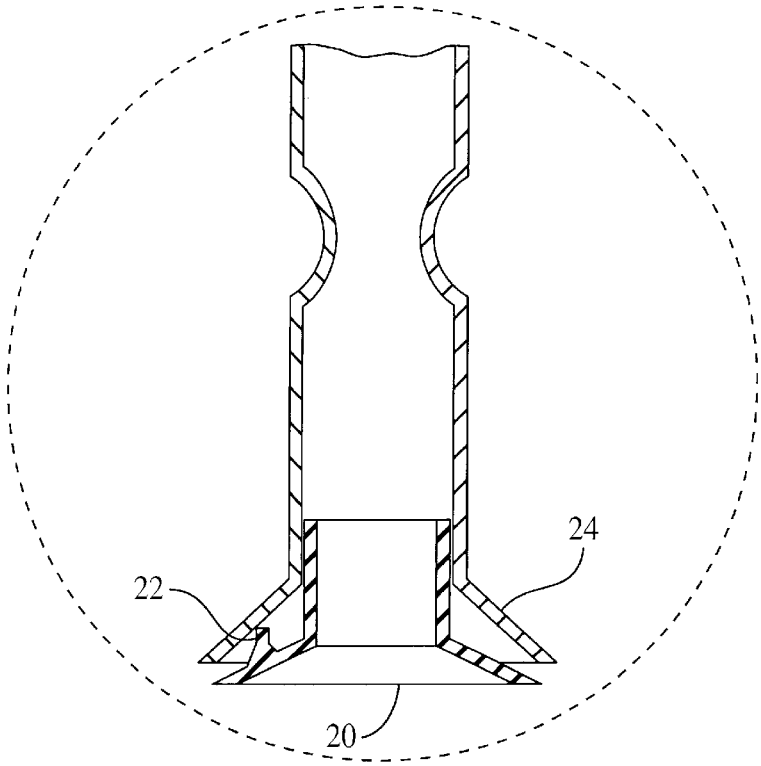
FIG. 2 is an enlarged vertical cross-section of the suction base of the first embodiment.

Referring to FIG. 2, a vertical cross-section view of the enlarged bottom opening 24 is illustrated. The enlarged opening consists of a bottom closure having a first outwardly concaved surface. The first concaved surface has a first central opening and a second opening. The suction base insert 20 consists of a top end and a bottom suction base. The bottom base has an outwardly concaved surface. The exterior wall of the suction base has a releasing tap 22. The top end of the suction insert is securely attached into the first central opening while the releasing tap 22 is movably retained inside the second opening. The suction base can be made of rubber, or other synthetic materials.

Therefore, when a user of the marker pushes the housing 26 against the floor, the concaved suction base 20 will be tightly attached onto the floor. When the user pushes the housing 26 to the side in a predetermined direction, the tap 22 inside the second opening will be moved by the enlarged bottom of the housing 26 and the movement of the tap 22 will disengage the suction base 20 from the floor and the suction base will be released from the floor. The marker can be conveniently stored on a wall by holding the marker's two grooves 28 through two clips on the wall in the area where hazard conditions frequently occur.

Figure 3:
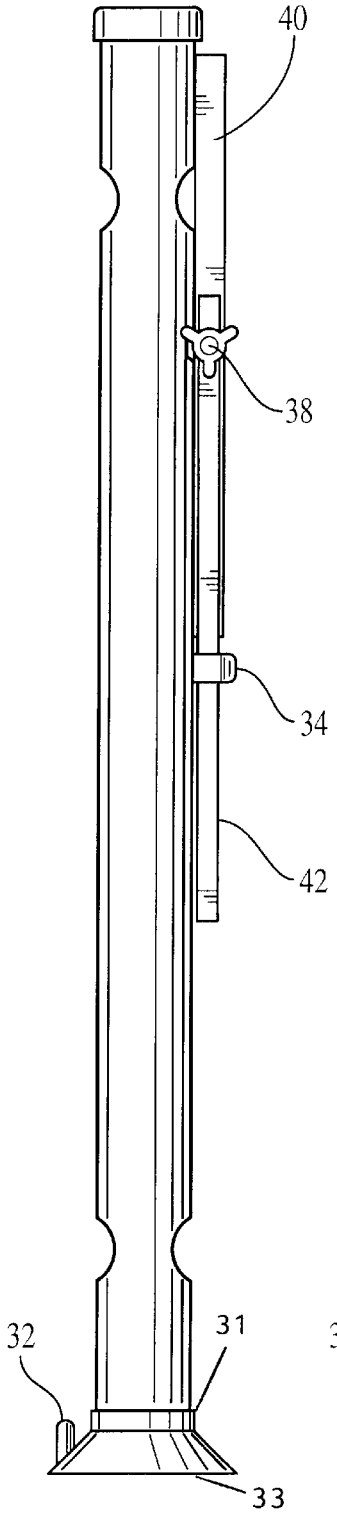
FIG. 3 is a third embodiment of the invention with the flag in a retracted position. Further, the suction base is a second embodiment of the present invention.

Referring to FIG. 3, the second embodiment of the present invention related to a suction base insert is depicted. The suction base insert has a receiving end 31, a bottom concaved surface 33, and a releasing tap 32 on the exterior wall of said concaved surface 33. The bottom end of the housing in this embodiment is not enlarged and can be securely inserted into the receiving end 31 of the suction base insert.

Therefore, by applying a vertical force downward on the housing, the suction base will be attached to the floor near the hazard conditions. Likewise, by applying a horizontal force upon pushing tap 32 at a predetermined direction, the suction base will be released from the floor. The exterior of the housing 26 will be painted in fluorescent color and/or with words warning walkers-by of the hazard conditions.

Figure 5A:
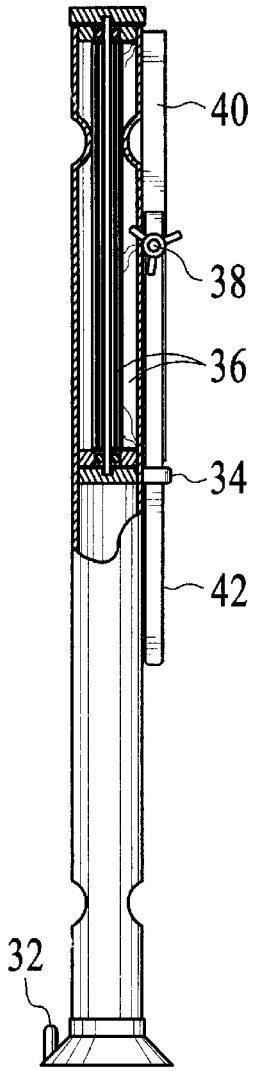
FIGS. 5A and 5B are views of the invention with a flag in an extended or a retracted position. The drawings also show the spring-loaded mechanical device inside the marker.
Figure 5B:
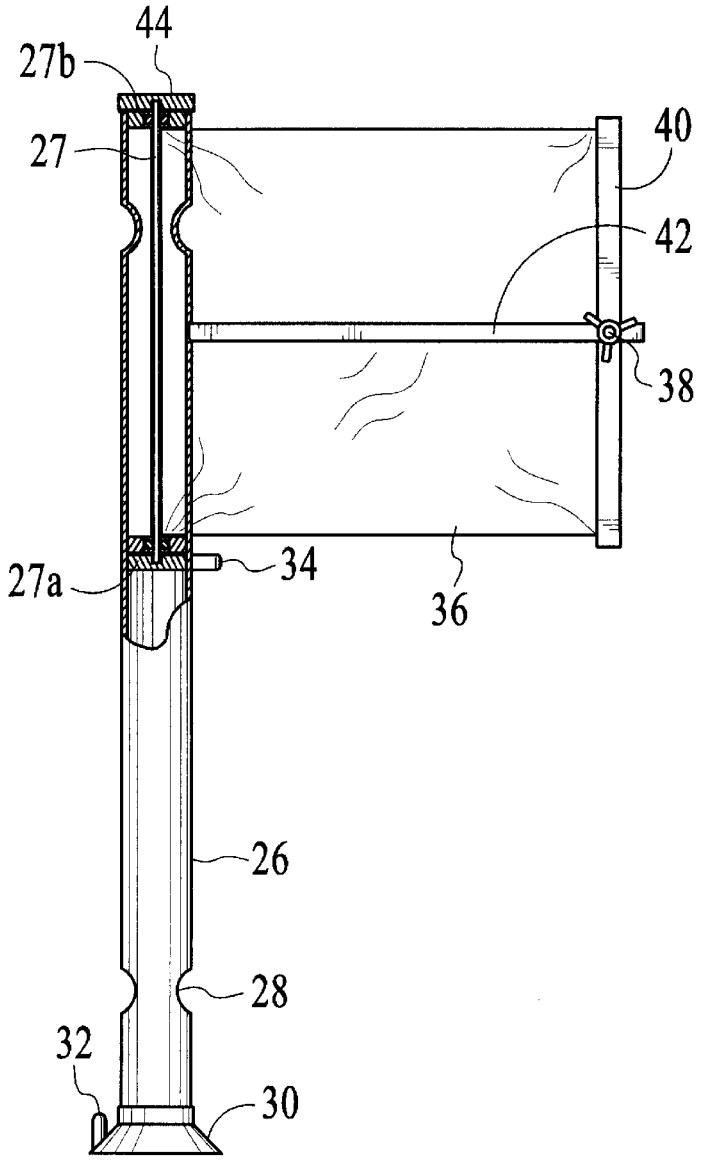

Referring to FIGS. 5A and 5B, another embodiment of the present invention is also depicted. The housing 26 contains a spring-loaded mechanical device 27 inside, which has an extendable and retractable flag 36 attached thereon. The spring-loaded mechanical device 27 is well known in the art and is readily commercially available in the market. The mechanism of spring-loaded mechanical device 27 is taught by commercial products, such as pull-down sunshades for use in car windows, or for use in windows in residences or offices. Pull-down sunshade products generally have a housing, a spring-loaded mechanical device with a sheet of shade attached. The sunshade housing is then securely attached to the car window or room window. When the sunshade is pull-down, one edge of the shade can be attached to the bottom of the window.

The installation of the spring-loaded mechanical device 27 into the housing 26 of the present invention is relatively simple. A person with ordinary skills in the field of mechanical engineering is readily capable of installing the device inside the housing. The device 27 has a top end 27*b* and a bottom end. The bottom end of the device 27 sits on a dstopper 27*a* inside the housing, which is a pin 27*a* attached across the inside wall of the housing. The top end 27*b* of the device 27 is rotatably attached to the top cap 44 of the housing 26. One edge of the flag 36 is attached to the spring-loaded device 27 while the opposite edge of the flag 36 is extended outwardly to the outside of the housing.

The housing 26 of the hazard marker in FIGS. 3, 5A and 5B has an opening slot on its wall not shown in FIG. 3. The length of the slot is greater than the width of the flag 36. One end of the slot meets the top opening of the housing, so that the flag 36 with the spring-loaded device 27 can slide into the housing through the opening slot. One edge of the flag 36 extends through the slot to outside and is securely attached to a first bar 40 across the edge of the flag 36. The thickness or diameter of the first bar 40 is greater than the width of the slot, so that the first bar 40 with the flag attached on will rest on the exterior wall of the housing when the flag 36 is in the retracted position as shown in FIGS. 3 and 5A. A second bar 42 is used for retaining the flag in an extended position. The second bar 42 is rotatably attached to the first bar 40 through a knob 38. When the flag 36 is in the retracted position, the second bar 42 will be retained in a clip 34.

Figure 4:
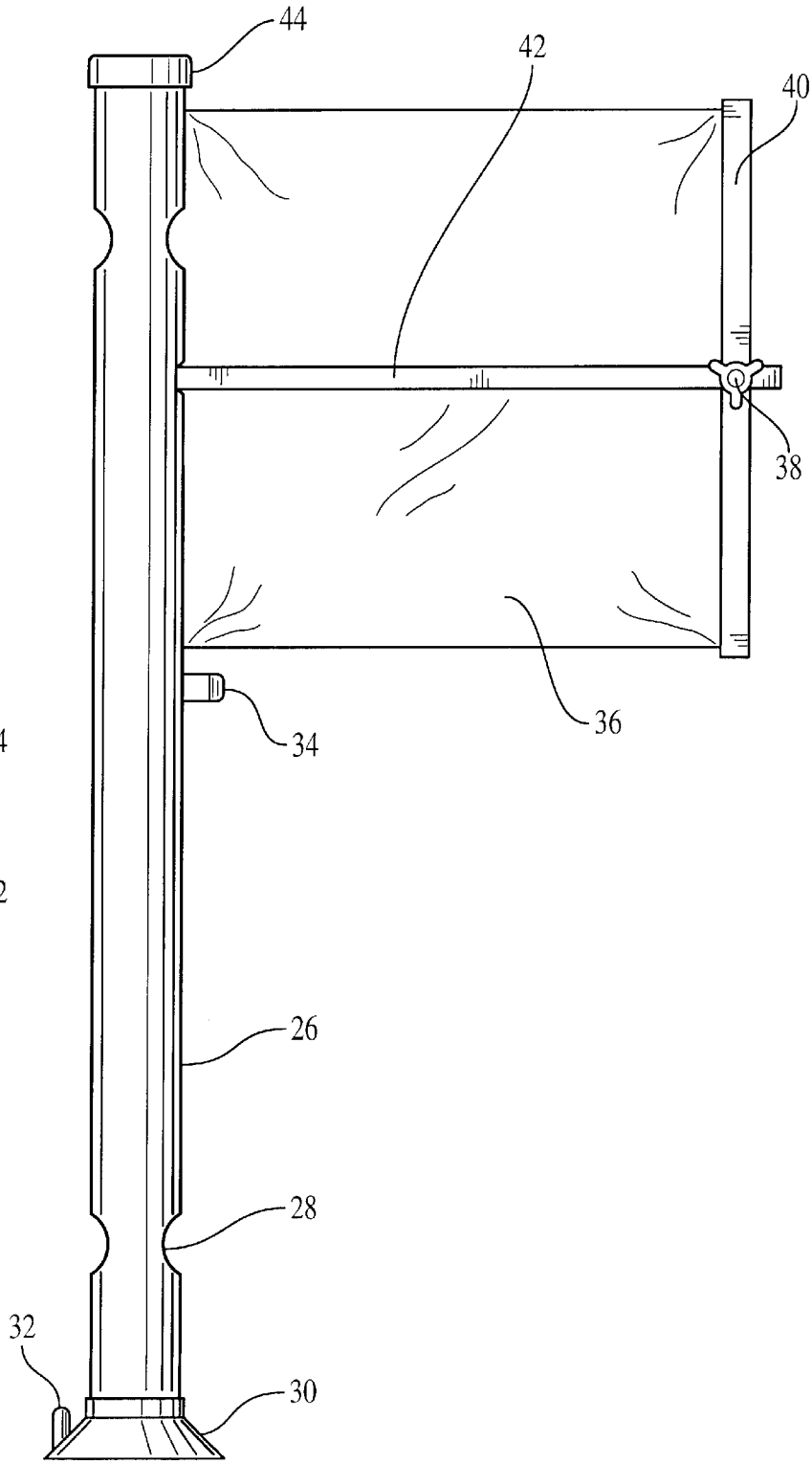
FIG. 4 is a third embodiment of the invention with the flag in an extended position. Further, the suction base is a second embodiment of the present invention.

Referring to FIGS. 4 and 5B, the flag 36 attached to the spring-loaded mechanical device 27 inside the housing 26 is in an extended position. The second end of the second bar 42 is positioned in a notch on the housing exterior for retaining the flag 36 in the extended position. When the second end of the second bar 42 is pulled away from the notch, the flag 36 with the first bar 40 will be pulled back by the spring-loaded mechanical device towards the slot on the housing 26. The second bar 42 will be retained by the clip 34. There is a top closure cap on the top end of the housing for keeping the spring-loaded device from slipping out of the housing.

It will be clear to those skilled in the art that the present invention is not limited to the specific embodiments disclosed and illustrated herein. Nor is it limited in application to hazard markers. Numerous modifications, variations, and full and partial equivalent can be undertaken without departing from the invention as limited only by the spirit and scope of the appended claims.

What is desired to be secured by Letters Patent of the United States is as follows:

1. A hazard marker comprising:

a housing having an interior wall, an exterior wall in fluorescent color, a top opening, and a bottom opening;

said bottom opening having a gradually enlarged diameter and a first outwardly concaved closure, said first closure having a first central opening and a second opening;

a cylindrical suction base insert having a top end and a bottom suction base, said suction base having a second outwardly concaved surface and an exterior surface, and a releasing tap on said exterior surface, said top end of said base insert being securely affixed into said first central opening and said releasing tap being movably retained inside said second opening, wherein said releasing tap is hidden by and in movable contact with said first outwardly concaved closure; whereby said second concaved surface of said suction base will be securely attached onto the floor when said housing is pushed downwardly against the floor, whereby said suction base will be released from the floor when an user of said marker pushes said housing to the side in a predetermined direction and said releasing tap is moved inside said second opening by said bottom opening of said housing.

2. The hazard marker according to claim 1, wherein said suction base is made of rubber.

3. The hazard marker according to claim 1, wherein said housing further comprising:

a spring-loaded mechanical means inside said housing, said spring-loaded mechanical means holding a retractable flag in fluorescent color, said spring-loaded means having a top end and a bottom end;

a stopping pin across the interior wall of said housing for supporting said mechanical means within said housing, whereby said bottom end of said spring-loaded means rotatably rests on said pin;

an opening slot on said housing wall near said top end of said housing, whereby said flag retractably passes through said slot;

a means for locking said flag in an extended position.

4. The hazard marker according to claim 3, wherein said means for locking said flag in an extended position consists of:

a first bar being securely attached to an edge of said flag outside said housing, said first bar having a diameter greater than the width of said slot, and said first bar resting outside said housing when said flat is in a retracted position;

a rotatable knob being attached to said first bar;

a second bar having a first end and a second end, said first end being rotatably attached to said knob;

a notch at said slot;

a clip on said exterior of said housing, whereby said flag is extended by pulling said first bar horizontally and said second end of said second bar is securely positioned into said notch in a locking position, whereby said flag is retracted into said housing through said slot by said spring-loaded means after said second bar is released from the locking position, whereby said second bar is rested and retained by said clip when said flag is retracted fully inside said housing.

5. A hazard marker comprising a housing, said housing having an interior wall, an exterior wall in fluorescent color, a top end and a bottom end, said housing having a slot near said top end;

a suction base insert for affixing said bottom opening to the floor, said suction base insert having a top receiving end, a bottom suction base having an outwardly concaved surface and an exterior surface, and a releasing tap on said exterior surface of said suction base, said receiving end securely affixed on to said bottom end of said housing, whereby said interior surface of said suction base will be securely attached onto the floor when said housing is pushed downwardly, whereby said suction base will be released from the floor when an user pushes said releasing tap in a predetermined direction;

a spring-loaded mechanical means inside said housing, said spring-loaded mechanical means holding a retractable flag in fluorescent color, said spring-loaded means having a top end and a bottom end;

a stopping pin across the interior wall of said housing for supporting said mechanical means within said housing, whereby said bottom end of said spring-loaded means rests on said pin;

a first bar being securely attached to an edge of said flag outside said housing, said first bar having a diameter greater than the width of said slot, and said first bar resting outside said housing when said flat is in a retracted position;

a rotatable knob being attached to said first bar;

a second bar having a first end and a second end, said first end being rotatably attached to said knob;

a notch at said slot;

a clip on said exterior of said housing, whereby said flag is extended by pulling said first bar horizontally and said second end of said second bar is securely positioned into said notch in a locking position, whereby said flag is retracted into said housing through said slot by said spring-loaded means after said second bar is released from the locking position, whereby said second bar is rested and retained by said clip when said flag is retracted fully inside said housing.

6. A hazard marker comprising:

a housing having an interior wall, an exterior wall in fluorescent color, a top opening, and a bottom opening; said bottom opening having a gradually enlarged diameter and a first outwardly concaved closure, said first closure having a first central opening and a second opening;

a cylindrical suction base insert having a top end and a bottom suction base, said suction base having a second outwardly concaved surface and an exterior surface, and a releasing tap on said exterior surface, said top end of said base insert being securely affixed into said first central opening and said releasing tap being movably retained inside said second opening, whereby said releasing tap is hidden by said first outwardly concaved closure; whereby said second concaved surface of said suction base will be securely attached onto the floor when said housing is pushed downwardly against the floor, whereby said suction base will be released from the floor when an user of said marker pushes said housing to the side in a predetermined direction and said releasing tap is moved inside said second opening by said bottom opening of said housing;

a spring-loaded mechanical means inside said housing, said spring-loaded mechanical means holding a retractable flag in fluorescent color, said spring-loaded means having a top end and a bottom end;

a stopping pin across the interior wall of said housing for supporting said mechanical means within said housing, whereby said bottom end of said spring-loaded means rotatably rests on said pin;

an opening slot on said housing wall near said top end of said housing, whereby said flag retractably passes through said slot;

a first bar being securely attached to an edge of said flag outside said housing, said first bar having a diameter greater than the width of said slot, and said first bar resting outside said housing when said flat is in a retracted position;

a rotatable knob being attached to said first bar;

a second bar having a first end and a second end, said first end being rotatably attached to said knob;

a notch at said slot;

a clip on said exterior of said housing, whereby said flag is extended by pulling said first bar horizontally and said second end of said second bar is securely positioned into said notch in a locking position, whereby said flag is retracted into said housing through said slot by said spring-loaded means after said second bar is released from the locking position, whereby said second bar is rested and retained by said clip when said flag is retracted fully inside said housing.

* * * * *